US006808105B2

(12) United States Patent
Lee

(10) Patent No.: US 6,808,105 B2
(45) Date of Patent: Oct. 26, 2004

(54) BOX FOR TRANSPORTATION

(75) Inventor: Sunju Lee, Gyeonggi-do (KR)

(73) Assignee: Dong-Jin Paper Board Box Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/035,917

(22) Filed: Dec. 28, 2001

(65) Prior Publication Data

US 2003/0100421 A1 May 29, 2003

(30) Foreign Application Priority Data

Dec. 30, 2000 (KR) ..... 20-2000-37258
Dec. 30, 2000 (KR) ..... 20-2000-37259
May 4, 2001 (KR) ..... 20-2001-13081

(51) Int. Cl.[7] ..... B65D 5/46

(52) U.S. Cl. ..... 229/117.25; 229/117.24; 229/117.09; 229/117.19

(58) Field of Search ..... 229/117.25, 117.26, 229/117.09, 117.19, 117.24; 220/755, 756, 759, 772

(56) References Cited

U.S. PATENT DOCUMENTS 2,191,291 A * 2/1940 Smith ..... 229/117.16
2,206,314 A * 7/1940 Werner ..... 229/117.16
2,723,073 A * 11/1955 Fellowes ..... 229/117.09
4,524,902 A * 6/1985 Mortimer ..... 229/117.09
5,037,027 A * 8/1991 Nichols ..... 229/198.1
5,074,461 A * 12/1991 Parker ..... 229/125.13
5,143,500 A * 9/1992 Schuring et al. ..... 411/339
5,282,832 A * 2/1994 Toso et al. ..... 606/232
5,462,221 A * 10/1995 Zink et al. ..... 229/117.16

FOREIGN PATENT DOCUMENTS

GB 2343883 * 5/2000 ..... B65D/5/44

* cited by examiner

*Primary Examiner*—Tri M. Mai
(74) *Attorney, Agent, or Firm*—Jordan and Hamburg LLP

(57) ABSTRACT

A box for transportation that has a bottom, which is composed of just one panel of paper, can be assembled without any particular fixing method in order to prevent loss of the contents inside of the box. After the two panels of one side of the box are overlapped, the perforations formed around the handle hole are joined and supported by a handle support thereby solving the problems of the prior art.

6 Claims, 13 Drawing Sheets

BOX FOR TRANSPORTATION

FIELD OF THE INVENTION

The present invention relates to a box made of paper or synthetic resins, which is used for transportation. The box has a bottom, which is composed of just one panel of paper, and can be assembled without any particular fixing method in order to prevent loss of the contents inside of the box.

DISCUSSION OF RELATED ART

Prior art boxes having a bottom, which is composed of just one plane facet of paper, as shown in FIGS. 17 to 19, have side facets (100, 100*a*, 100*b*) folded and fixed only by staples (300) or glue, so that when the box is formed, the handle (400) on the sides is formed by cutting.

Because staples (300) or glue are used to assemble the box, this addition of another composition makes it inconvenient to produce and to recycle the boxes as well as to dissemble the boxes. Additionally, this makes the volume of the box too large during transportation, which results in high transportation costs. Also the handle (400) that is formed by cutting the sides of the box can be easily torn by the contents.

In order to solve the above-mentioned problems, a box of the present invention, has two panels on one side that overlap each other, and the perforations are formed around the handle hole. A handle support that a combination apparatus and so on are formed is combined, and the said problems of the prior art are solved.

BRIEF DESCRIPTION OF THE ATTACHED DRAWINGS

DETAILED DESCRIPTION OF PREFERRED EMBODIMENT

The following is the detailed description of the most desirable embodiment of the present invention according to the attached drawings.

Figure 1:
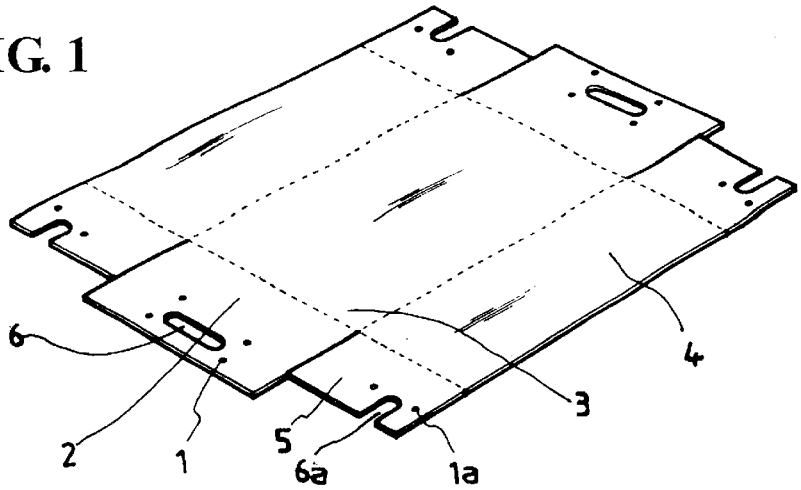
FIG. 1 is a perspective view showing the preferred embodiment of the present invention.
Figure 2:
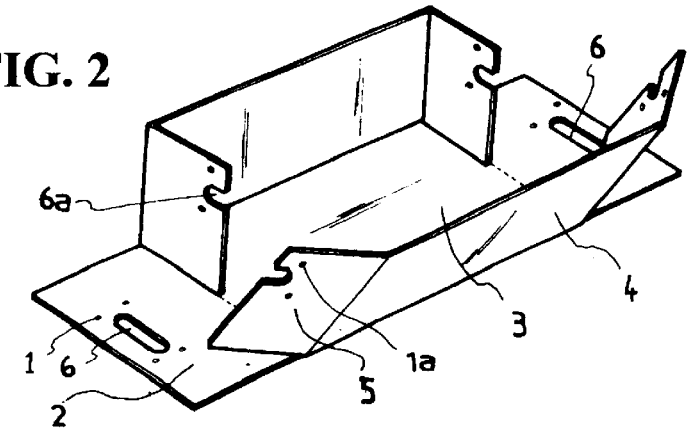
FIG. 2 is an assembling view showing how a box of FIG. 1 is assembled.
Figure 3:
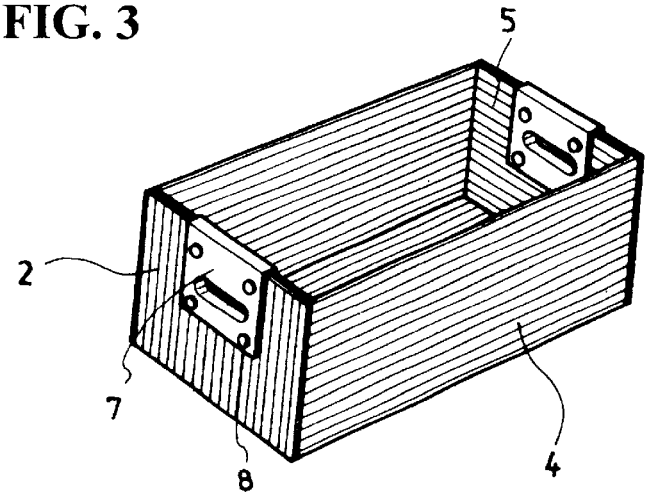
FIG. 3 is a perspective view showing how a handle support is combined with a box made of synthetic resins as shown in FIG. 1.
Figure 4:
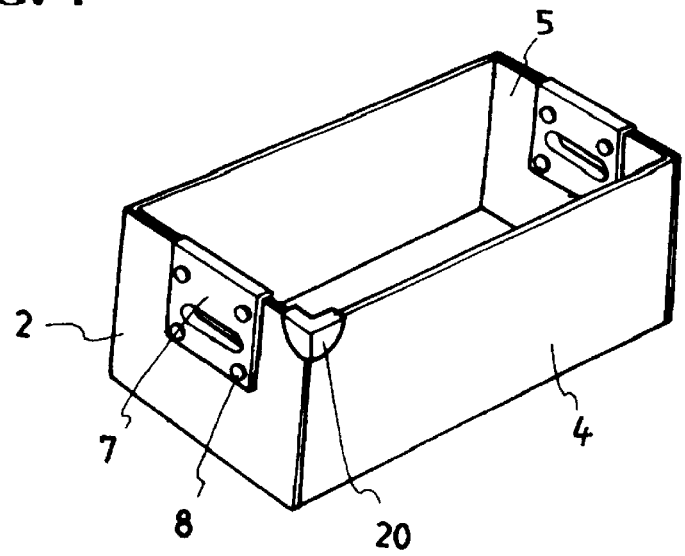
FIG. 4 is a perspective view showing a corner fixing apparatus installed.

As shown in FIGS. 1 to 3, the present invention is composed as a rectangular parallelepiped, having a bottom (3), composed of just one panel of paper and a first side panel (2), second side panels (4) connected to the bottom (3), and third side panels (5), which extended from the second side panels (4) and overlap the first side panel (2) when the box is assembled.

The handle hole (6) is perforated on the first side panel (2). And the third side panels (5) each have a divided portion of the handle hole (6*a*).

The third side panel (5) is positioned on the inside of the first side panel (2), so that each divided handle hole (6*a*) can overlap each other. The box is assembled by combining a biased retaining member (8) and a sleeve (9), which are formed on the handle support (7). The handle support inserts through the perforations (1, 1*a*) on the first side panel (2) and the third side panel (5), and then protrusion hoops (10, 10*a*) interlock with each other in the handle hole (6).

Figure 8:
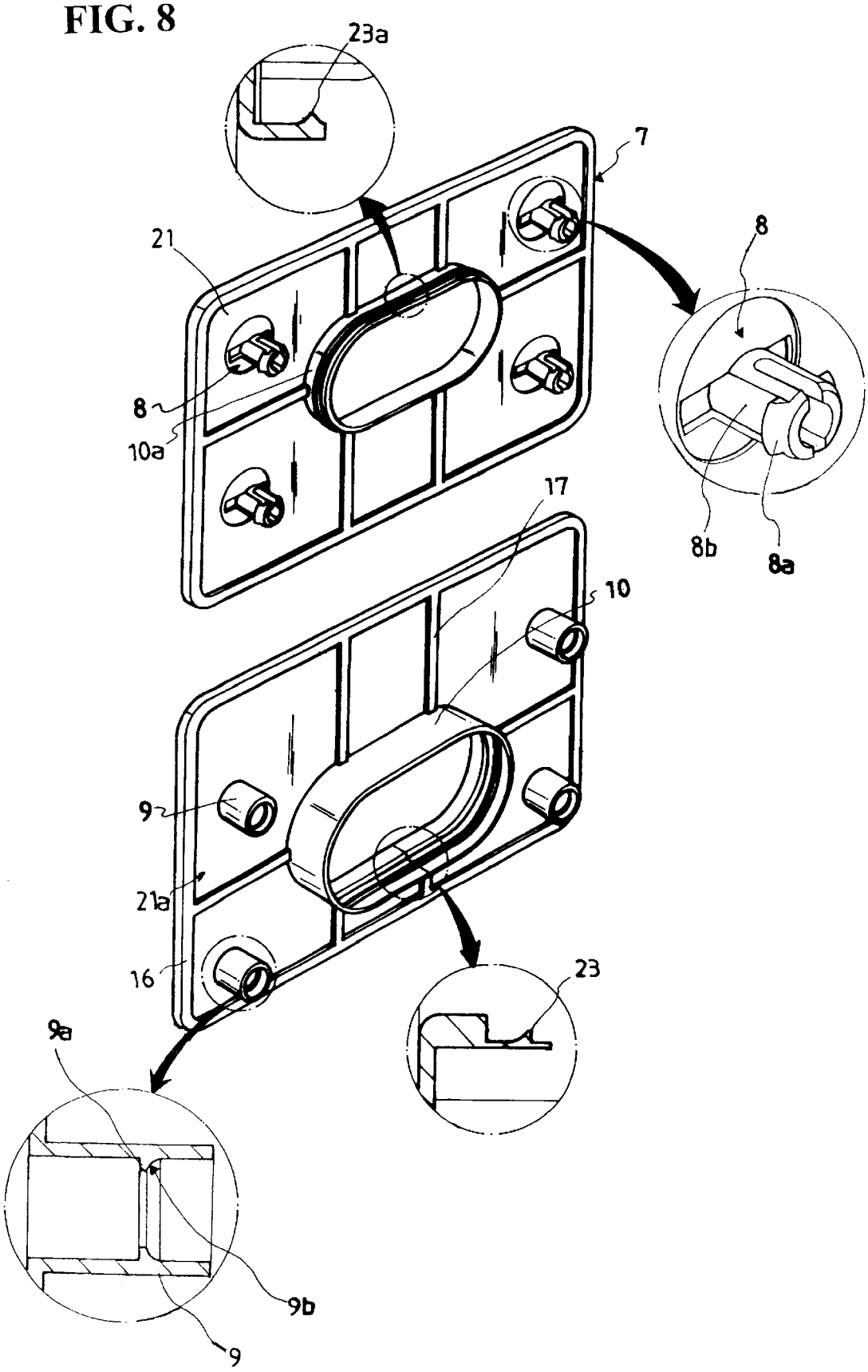
FIG. 8 is a perspective view showing how the handle support is dissembled.
Figure 9:
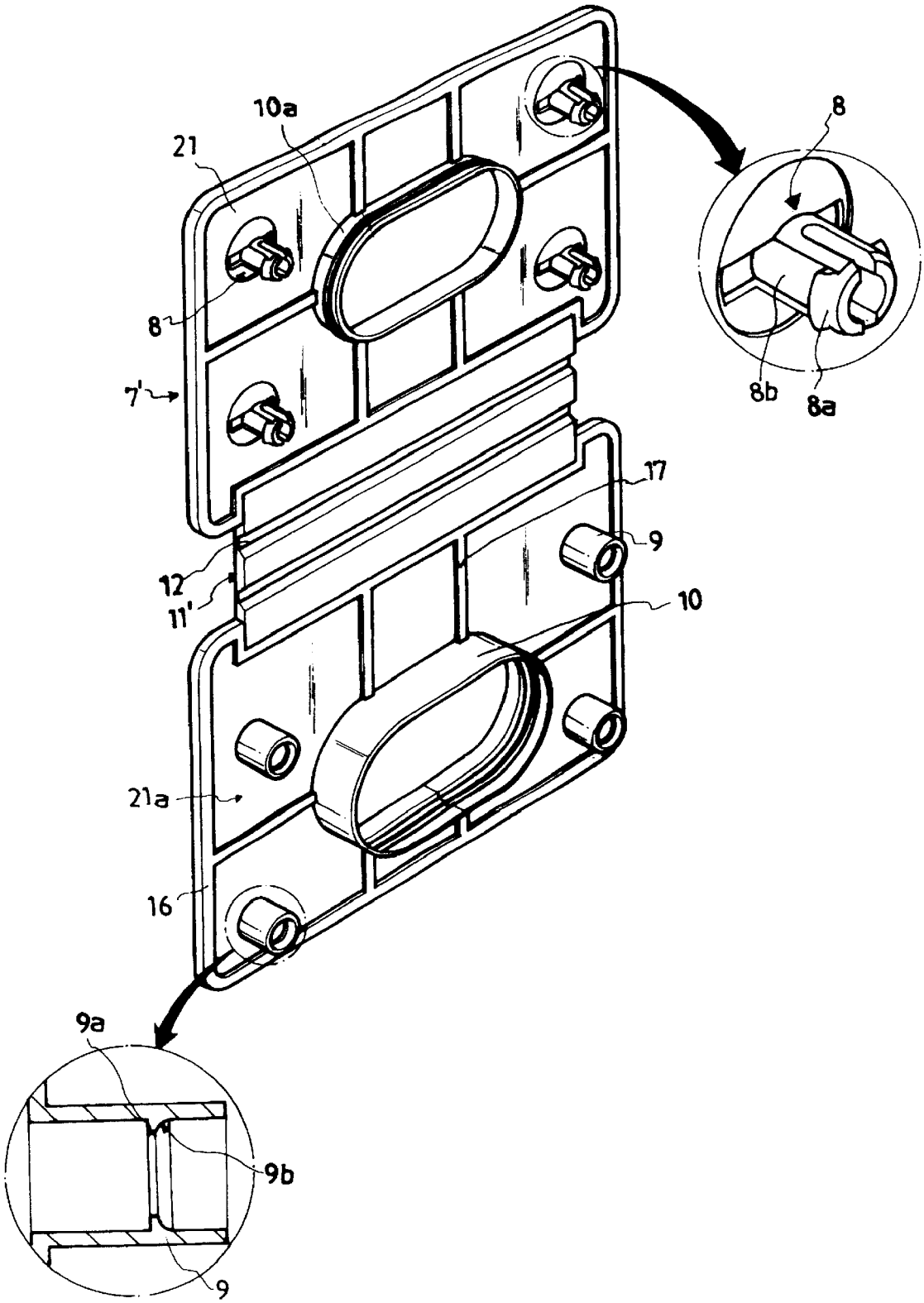
FIG. 9 is a perspective showing how the handle support is formed as one piece with a folding part.

As shown in FIGS. 8, 9 12, 13 and 14, the handle support can be formed as two separate pieces (7) that are linked through handle hole (6), or as one piece (7') joined by a bendable connection, or as two separate pieces (7") that can be attached at one side by a solid connector (11), or as two separate pieces (7'") in which one piece includes a solid connector portion (11'). As shown in FIG. 8, the handle support (7) composed of two pieces can be dissembled. Alternatively, the handle support can be formed as one piece (7') which can be folded for assembly in the box as shown in FIG. 9. In this embodiment, folding lines (12) are formed on the folding connector (11') in order to make it convenient to fold the handle support (7').

Figure 10:
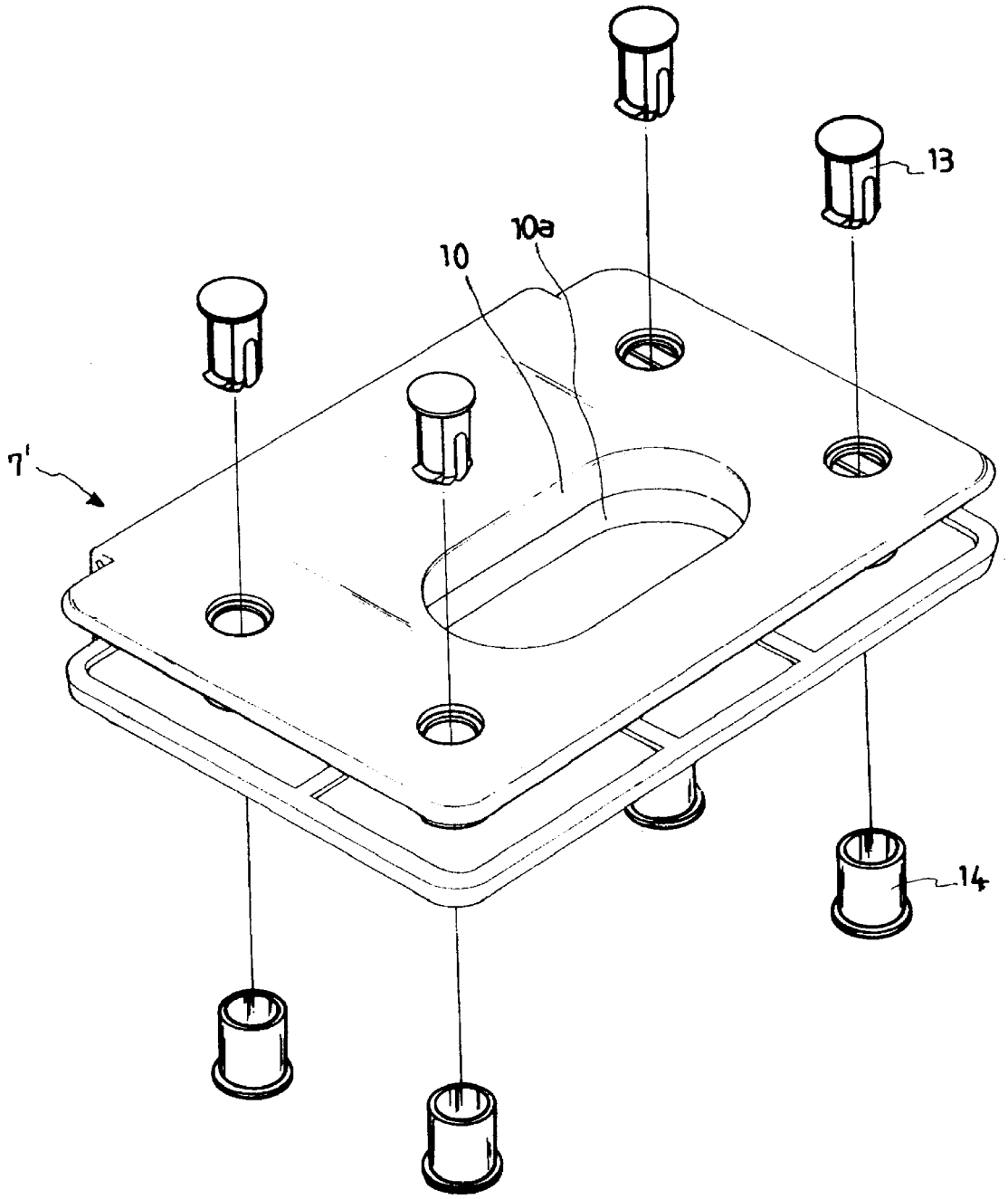
FIG. 10 is a perspective view showing that a biased retaining members and sleeves combine the handle support.

The handle support (7") can also be made with perforations to accommodate assembly with a separate biased retaining member (13) and sleeve (14) as shown in FIG. 10.

Figure 5:
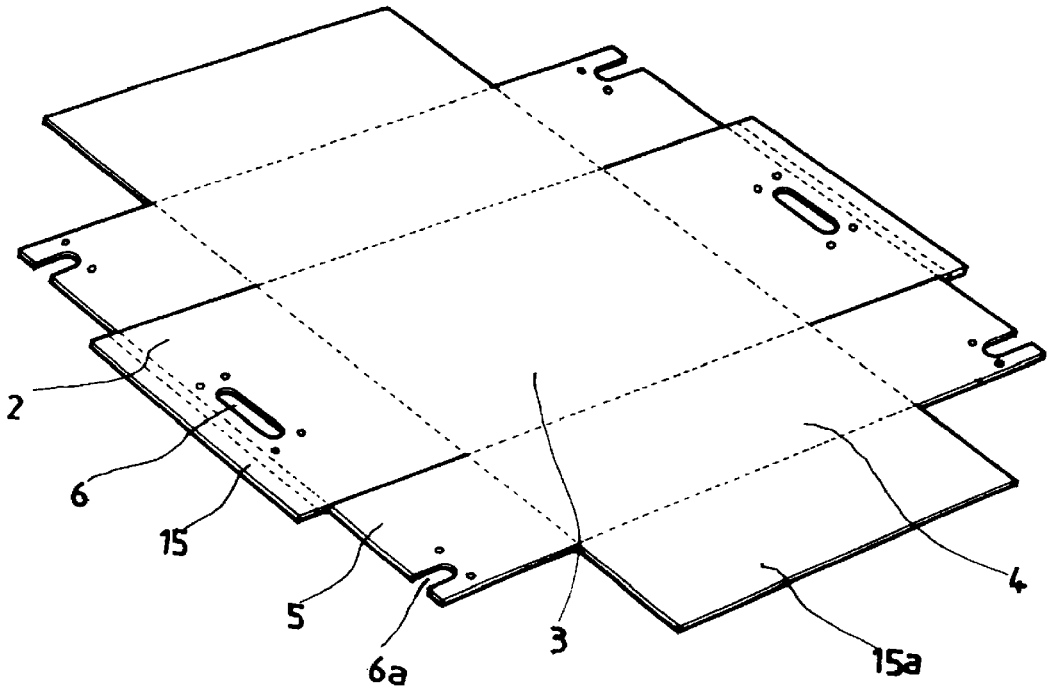
FIG. 5 is a perspective view showing another embodiment of the present invention.
Figure 6:
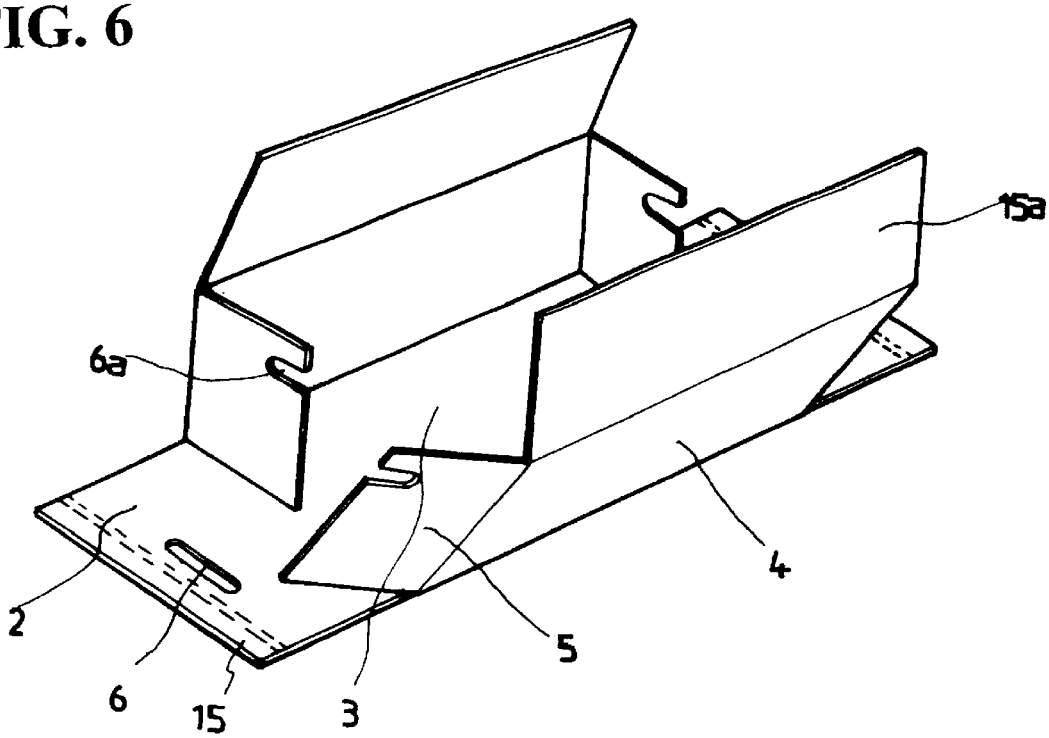
FIG. 6 is a perspective view showing how a box of FIG. 5 is assembled.
Figure 7:
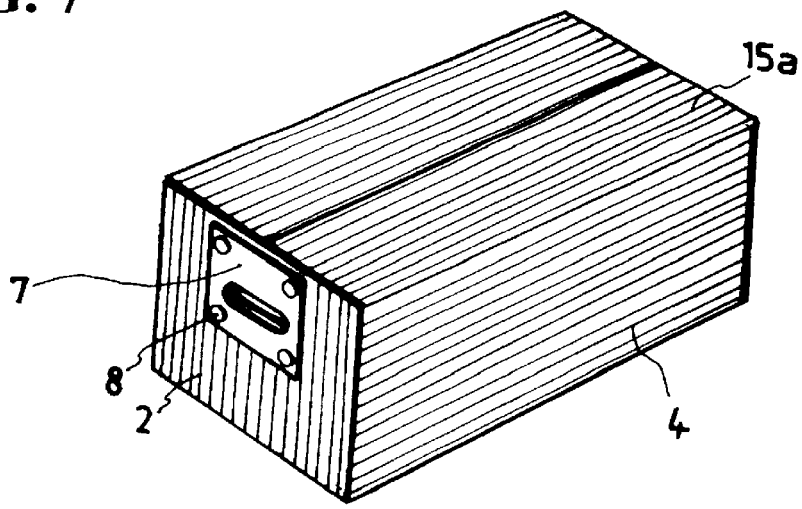
FIG. 7 is a perspective view showing how another handle support is combined with a box made of synthetic resins as shown in FIG. 5.

As shown in FIGS. 5 to 7, cover sheets (15*a*, 15), that extend from the second side panel (4) and the first side panel (2) respectively, complete the box. The cover sheets (15*a*), which extend from the second side panel (4), cover the assembled box tightly due to the cover sheets (15), which extend from the first side panel (2).

In addition, protrusion hoops (10, 10*a*) are formed to protrude inside the handle hole formed in the handle and can be interlocked with each other in the handle hole (6), so that the handle is sturdy.

As shown in FIGS. 8, 9 and 12–14, the handle support, formed as either one solid piece or two separate pieces, consists of two cover sheets (21, 21*a*). A handle hole is formed on the center of the cover sheets (21, 21*a*) in the same shape as the handle hole (6) of the box. The protrusion hoops (10, 10*a*) protrude toward the inside of the handle hole and the protrusion hoops (10, 10*a*) are formed on the cover sheets (21, 21*a*).

An inward sill (23) and an outward sill (23*a*) are formed in the protrusion hoops (10, 10*a*) and can interlock with each other.

In addition, as shown in FIG. 8, the biased retaining member (8) and the sleeve (9), that are combined through the perforations (1), are easily interlocked with each other, and contain an elasticity flake (8*b*), formed with a hooking protrusion (8*a*), in order to prevent separation of the interlocked biased retaining member and sleeve. A hooking hoop (9*a*) is formed on the inside of the sleeve (9), which interlocks with the hooking protrusion (8*a*) on the sleeve (8). An incline (9*b*) is formed on the forward part of the hooking hoop (9*a*), so that the biased retaining member (8) can be inserted easily.

Figure 11:
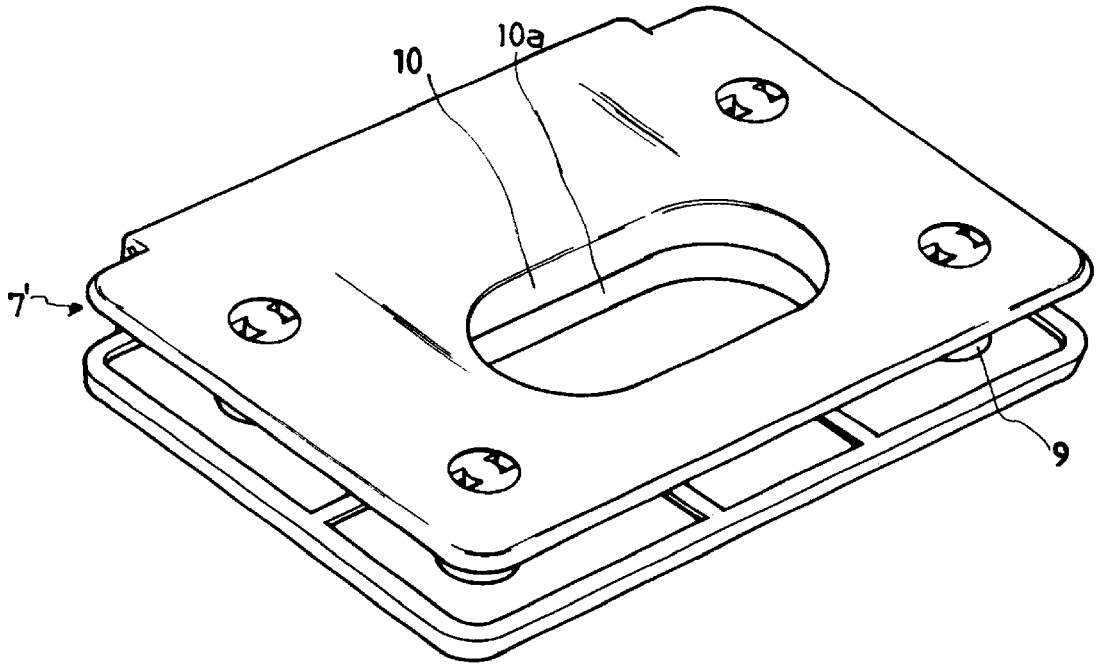
FIG. 11 is a perspective view showing how the handle support is folded.
Figure 11A:
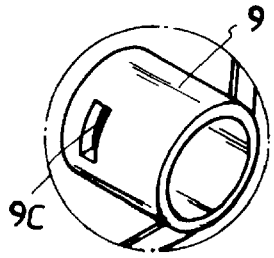
FIG. 11A is a perspective view showing that holes are formed on the sleeve.
Figure 12:
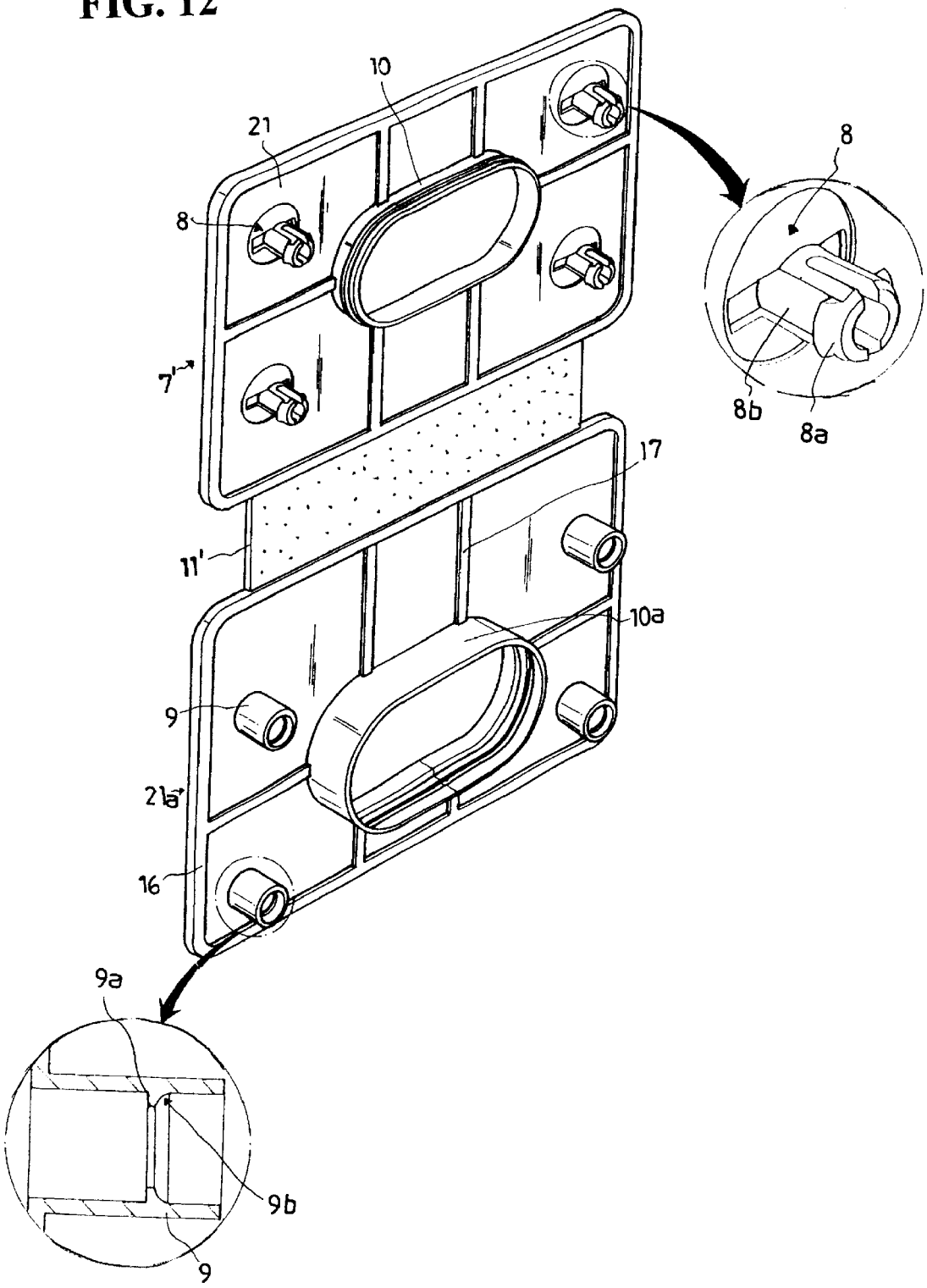
FIG. 12 is a perspective view showing how the handle support is formed as one piece in soft material.
Figure 13:
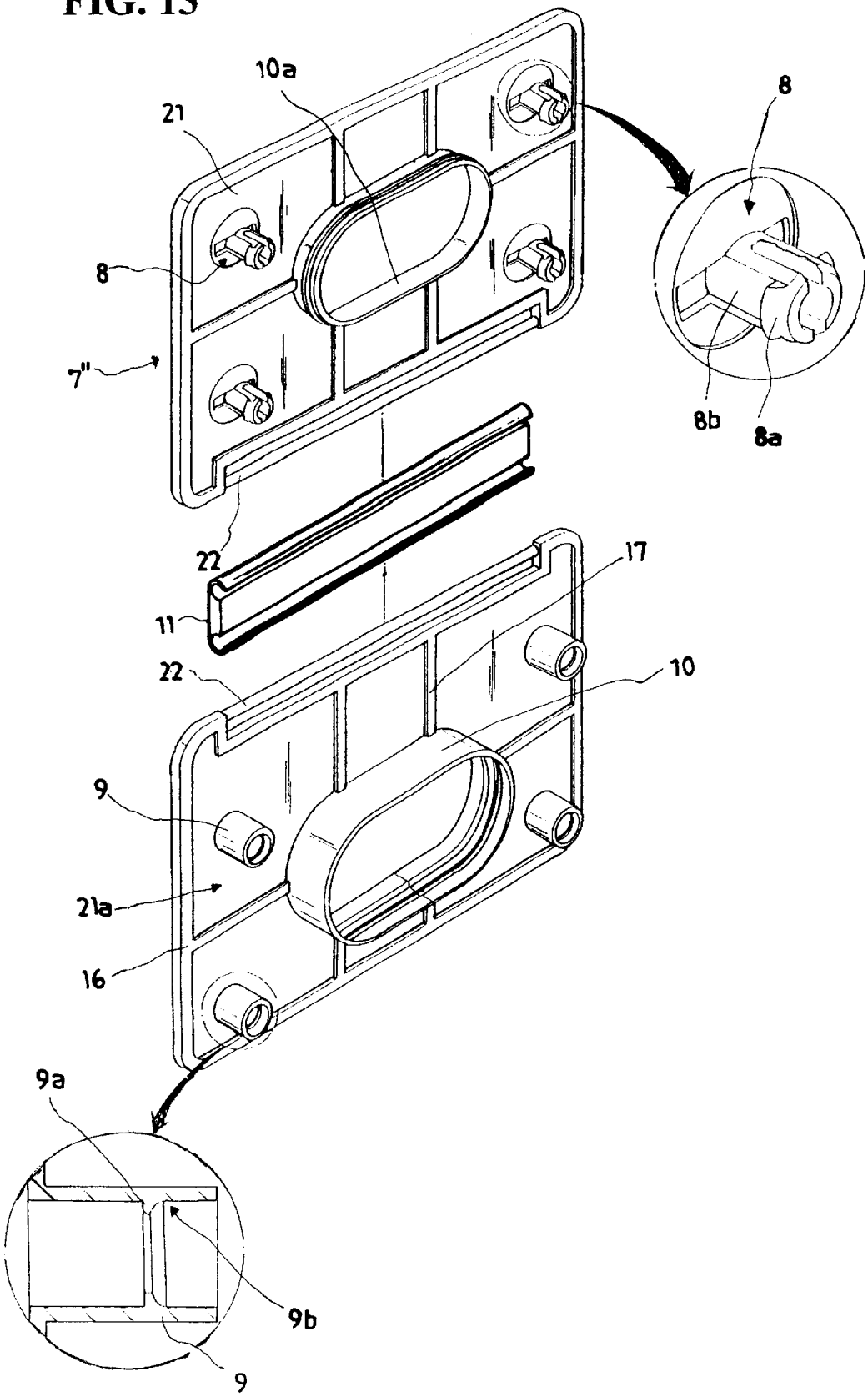
FIG. 13 is a perspective view showing how the folding part of the handle support is dissembled and combined.
Figure 14:
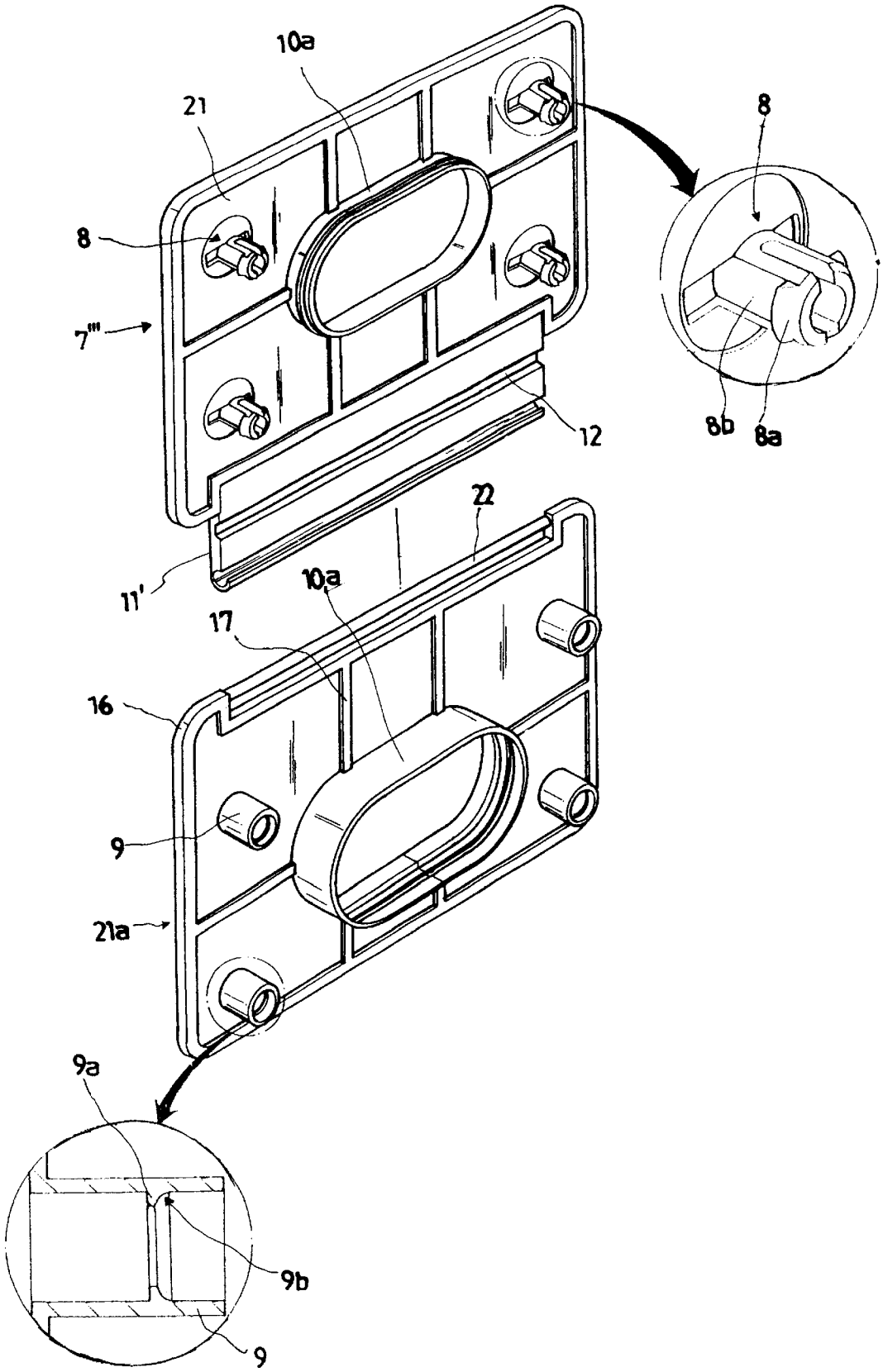
FIG. 14 is a perspective view showing how the folding part of the handle support is formed on just one side of the handle support.
Figure 15:
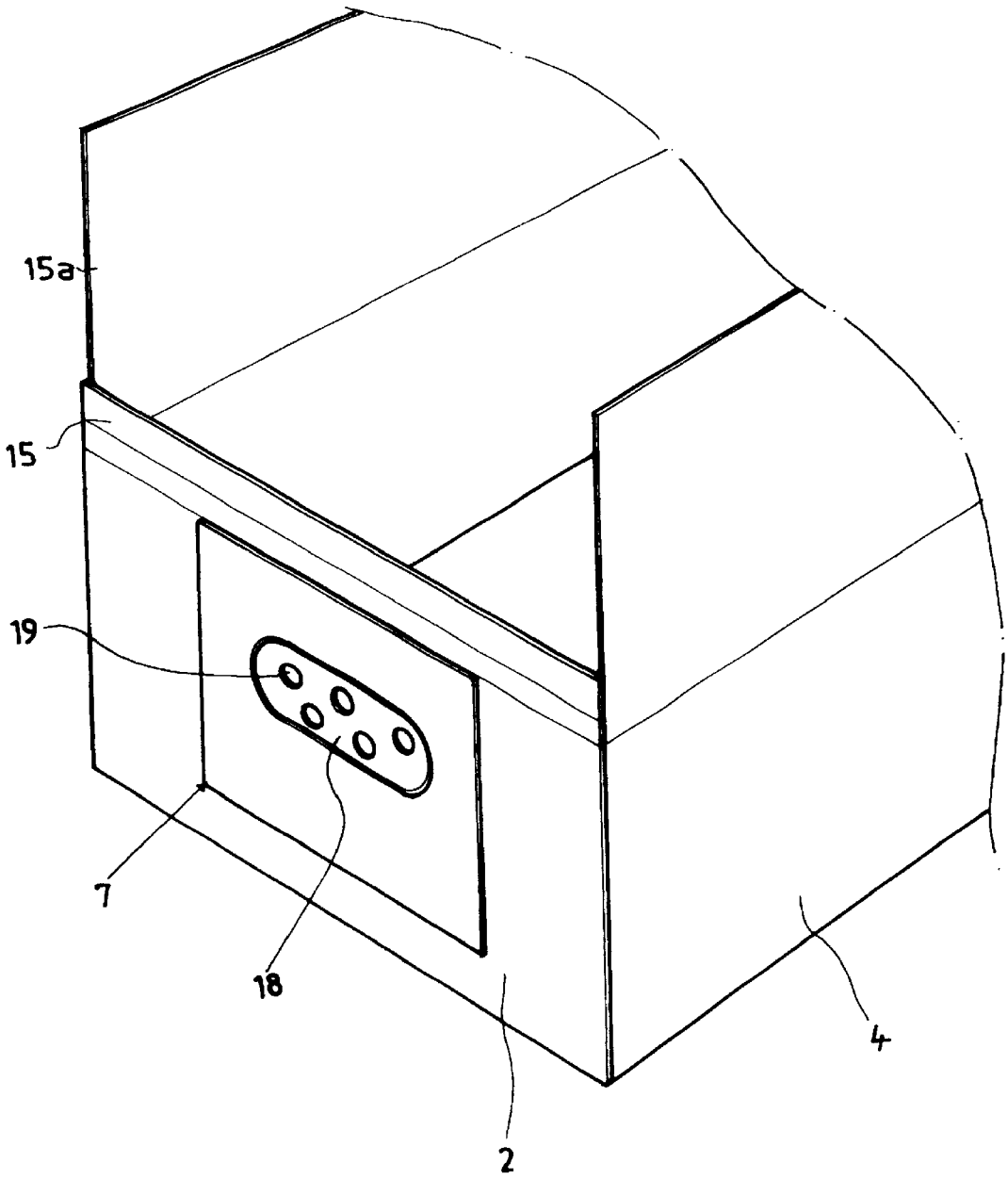
FIG. 15 is a perspective view showing how a stopper, is formed by perforations on the handle support.
Figure 16:
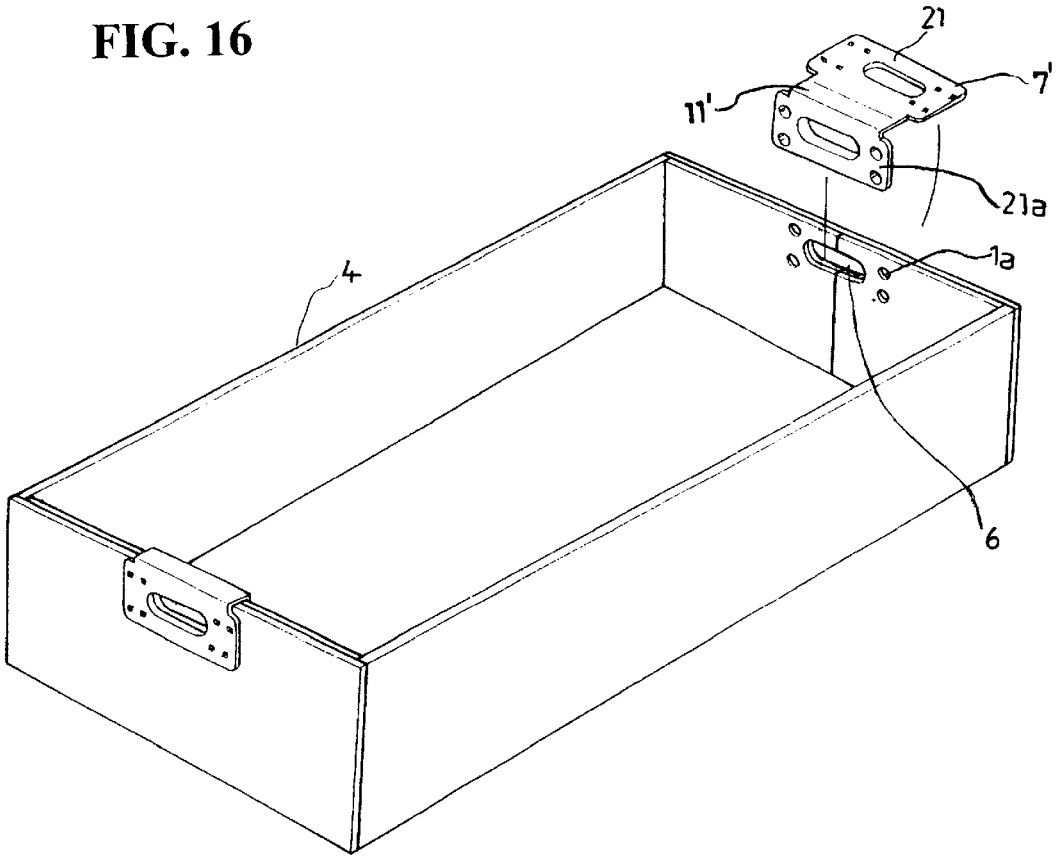
FIG. 16 is a cross sectional view showing how the handle support is combined with a previously assembled box.
Figure 17:
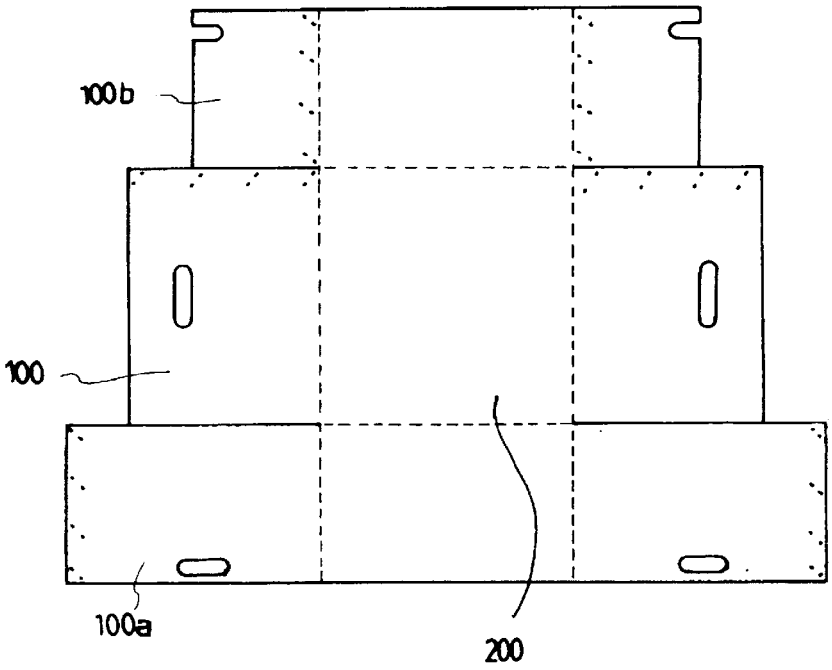
FIG. 17 is a development view of the prior art.
Figure 18:
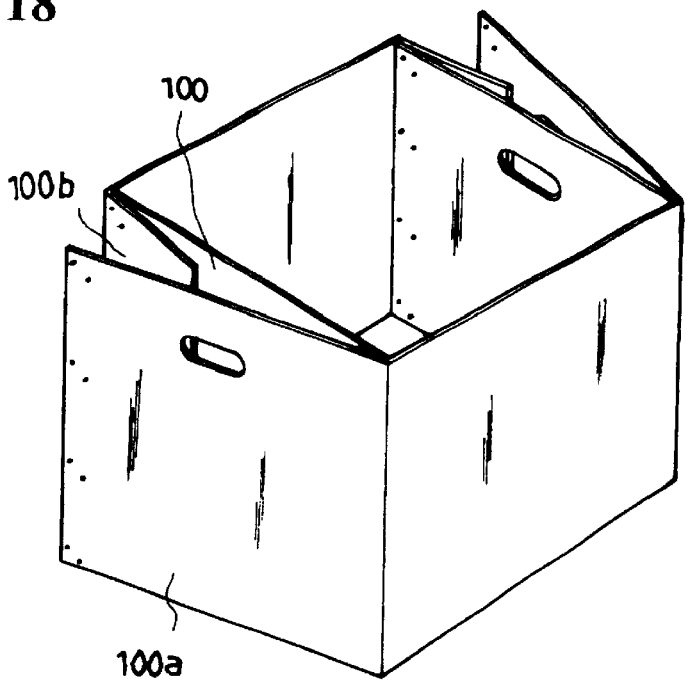
FIG. 18 is an assembling view showing how a box of the prior art is assembled.
Figure 19:
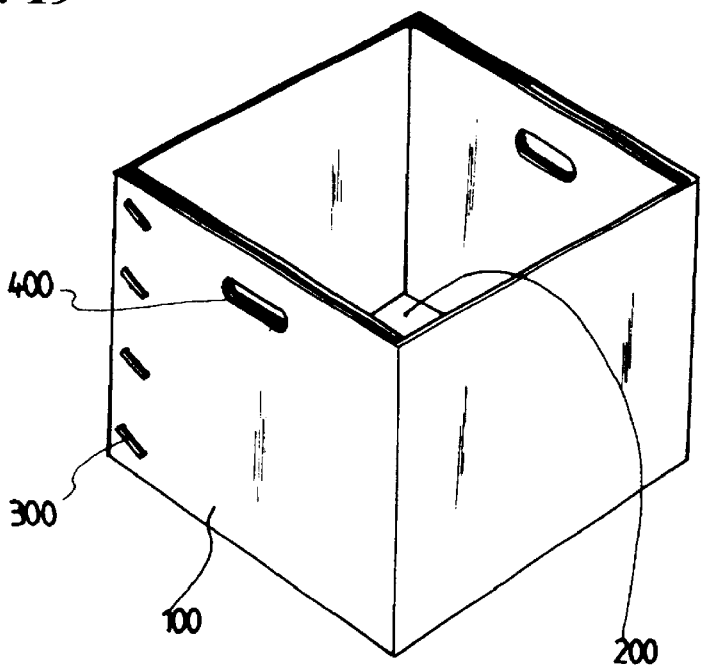
FIG. 19 is a perspective view showing how a box of the prior art appears having been assembled.

As shown in FIG. 11A, in order that the hooking protrusion (8*a*) of the biased retaining member (8) can be hooked, holes (9*c*) are formed on the sleeve(9), in a number equal to the number of elasticity flakes (8*b*), formed in the biased retaining member (8). As shown in FIG. 12, when the cover sheets (21, 21*a*) are formed as one piece joined by the folding connector (11'), the folding connector (11') is molded with a soft material by double injection, so that it is easily folded and designed in various shapes. As shown in FIG. 13, the connector (11) can be formed as a separate composition and assembled with a hinge (22), or as shown in FIG. 14, the folding connector (11') can be formed on one cover sheet (21), and assembled with the other cover sheet (21*a*) by the hinge (22).

Furthermore, a strengthening border (16) and a strengthening rib (17) are formed on the cover sheets (21, 21*a*), so that the cover sheets (21, 21*a*) are not easily bent. This border and rib can be used as an advertisement when formed in various designs such as logos and trademarks.

In addition, a stopper (18) is formed in the handle hole of the cover sheets (21, 21*a*), so that other materials cannot be inserted into the box. Holes (19) are formed on the stopper (18) and the stopper (18) is folded or detached individually.

A corner fixing apparatus (20) is installed on each corner, after the box is assembled.

FIG. 11 shows the handle support (7') folded.

Before a user uses the box, it can be transported and stored completely unfolded, so the transportation cost can be minimized. After the first side panel (2) and the third side panel (5) are folded and overlap with each other, the handle holes (6) and the perforations (1) are adjusted one to another using a handle support, so the box is easily assembled.

Assembly is achieved by a combination of the biased retaining member (8) and the sleeve (9), and a separate biased retaining member (13) and sleeve (14) may also be used.

Thus, after the box is assembled and strengthened by the assembly of the handle support, the box can be easily dissembled to the unfolded starting position and recycled.

What is claimed is:

1. A box for transportation, comprising;

a bottom, composed of one panel of paper, first side panels and second side panels connected to the bottom, wherein the first side panels have handle holes and perforations formed around the handle holes, third side panels which extend from the second side panels and overlap the first side panels when the box is assembled, the third side panels having handle holes that overlap with the handle holes of the first side panel when the box is assembled and perforations that overlap with the perforations formed around the handle holes when the box is assembled, a handle support which inserts through both sides of the handle holes on the first and third side panels when the box is assembled, wherein the handle support is formed as two separate pieces that are joined by a folding connection, and, a biased retaining member and a sleeve formed to combine through the perforations in the first and third side panels and secure the handle support in the handle holes on the first and third side panels when the box is assembled.

2. The box for transportation of claim 1, wherein the folding apparatus is molded with a soft material by double injection.

3. The box for transportation of claim 1, wherein the handle support has protrusion hoops formed on one side of the handle support to fold together and support the handle hole when the handle support is inserted through the handle holes on the first and third side panels when the box is assembled.

4. The box for transportation of claim 1, wherein the handle support has perforations through which a separate biased retaining member and sleeve can interlock to hold the handle support in place through the handle holes on the first and third side panels when the box is assembled.

5. The box for transportation of claim 1, wherein the biased retaining member is formed as an elasticity flake having a hooking protrusion, and wherein the sleeve has a hooking hoop having an inclined region facing one external opening formed on the inside of the sleeve such that the biased retaining member can be easily inserted into and interlock with the sleeve.

6. The box for transportation of claim 1, wherein the handle support comprises a strengthening border and a strengthening rib.

* * * * *